US007013757B2

(12) United States Patent
Saviano et al.

(10) Patent No.: US 7,013,757 B2
(45) Date of Patent: Mar. 21, 2006

(54) BEVERAGE CONTAINER OPENING DEVICE

(76) Inventors: Danen P. Saviano, 1 Hillcrest Pl., Norwalk, CT (US) 06850; Paul G. Saviano, 1 Hillcrest Pl., Norwalk, CT (US) 06850

( * ) Notice: Subject to any disclaimer, the term of this patent is extended or adjusted under 35 U.S.C. 154(b) by 225 days.

(21) Appl. No.: 10/697,095

(22) Filed: Oct. 31, 2003

(65) Prior Publication Data

US 2004/0089105 A1 May 13, 2004

Related U.S. Application Data

(60) Provisional application No. 60/423,532, filed on Nov. 5, 2002.

(51) Int. Cl.
*B67B 07/00* (2006.01)

(52) U.S. Cl. ..... 81/3.37; 81/3.55

(58) Field of Classification Search ..... 81/3.07, 81/3.36, 3.37, 3.29, 3.55
See application file for complete search history.

(56) References Cited

U.S. PATENT DOCUMENTS

| | | | | |
|---|---|---|---|---|
| 4,615,241 A | | 10/1986 | Grabarski et al. | |
| 4,768,402 A | | 9/1988 | Kele | |
| 4,833,948 A | | 5/1989 | Jones | |
| 4,846,025 A | | 7/1989 | Keller et al. | |
| 4,852,431 A | | 8/1989 | Frangel | |
| 5,617,765 A | | 4/1997 | Bennett | |
| 5,647,413 A | * | 7/1997 | Horrell | 141/108 |
| 5,911,794 A | * | 6/1999 | Nordhoff | 81/3.55 |
| 6,105,468 A | * | 8/2000 | Fohrman et al. | 81/3.09 |
| 6,148,692 A | | 11/2000 | Russell | |
| 6,276,013 B1 | | 8/2001 | Hansen et al. | |
| 6,451,688 B1 | | 9/2002 | Shimpuku | |
| 6,460,719 B1 | | 10/2002 | Finmark | |

* cited by examiner

*Primary Examiner*—Jacob K. Ackun, Jr.
(74) *Attorney, Agent, or Firm*—Bacon & Thomas, PLLC

(57) ABSTRACT

A device including a body portion having proximal and distal end areas, and defining an internal cavity opening at the distal end area, and a channel that extends along a perimeter of the internal cavity in a spiral inclined planar configuration leading from the opening of the internal cavity and terminating at an apex region of the internal cavity. The distal end area of the body portion is configured and dimensioned to be placed upon a top portion of a beverage container and rotated thereon. Upon rotation of the body portion, the channel is configured so as to engage a lift-tab lever on a beverage container and progressively urge the lift-tab lever upwardly as the body portion of the present invention is rotated.

19 Claims, 3 Drawing Sheets

BEVERAGE CONTAINER OPENING DEVICE

This application claims the benefit of Provisional Patent Application Ser. No. 60/423,532 filed 5 Nov. 2002.

BACKGROUND OF THE INVENTION

1. Field of the Invention

The present invention relates to a device for opening a beverage container, and more specifically to a device arranged to utilize the mechanical characteristics of an inclined plane to lift a lift-tab lever on a conventional lift-tab beverage container.

2. Discussion of the Related Art

Lift-tab beverage containers are well known in the art. Typically, such containers are opened by lifting one end of a lift-tab lever to cause the other end thereof to open a door in the top of the can. By opening the door, the contents inside the can may be dispensed through the opening.

The modern lift-tab beverage container has become globally standardized for reasons of applicability, reliability, modes of distribution, storage, and sales. This conventionality results in little or no variation in the size and structures of the container in spite of a large variety of manufacturers. In addition, the typical lift-tab beverage container is round and has strong elements of concentricity.

A problem persists with such containers in that some persons have difficulty locating or operating the lift-tab lever on such containers due to physical challenges, and repetitive motion. The requisite manipulation of the lift-tab lever can also limit access to the contents of such containers for individuals with visual deficits, impaired fine motor skills or reduced dexterity in their hands and fingers caused by a variety of well known illnesses or injuries. In addition, some individuals with no impairment of their dexterity may choose not to operate the lift-tab lever in the prescribed way for personal reasons due to the size of their fingers, the quality and importance of their nails and fingers, or for reasons of increased risk of repetitive motion injury related to their occupation.

It is understood that persons recovering from certain injuries requiring rehabilitation to regain dexterity in their fingers are known to benefit from enlarged versions of ordinary devices. Larger than normal gripping areas on pens, pencils, and eating utensils are commonly employed during the early stages of rehabilitation to compensate for dexterous losses. As rehabilitation progresses and dexterity improves, gripping areas can be progressively reduced to normal sizes. For manual operations, however, where enlargement of a gripping surface is not practical or possible, a device that can provide a person with limited dexterity a method for performing a high dexterity operation is of great benefit. In the case of a beverage container, enlargement of the lift-tab lever is not practical, therefore some other means of lifting the lift-tab lever with a low dexterity motion is required.

While levers and wedges may be used as means to engage and lift lift-tab levers on beverage containers, such levers and wedges still require a level of dexterity and alignment that make them marginal solutions at best. In fact, these devices actually add to the complexity of opening the container as they are usually employed as the first part of a multi-step process to initiate the lifting of the lift-tab lever to a point where a finger can complete the process of opening of the container.

Accordingly, there is a need for a device that combines the features of self alignment, initial automatic engagement, and then complete lift of the lift-tab lever to open a beverage container. Furthermore, there is also a need for opening a beverage container with consistent and low dexterity motion. In this regard, the present invention substantially satisfies such needs.

SUMMARY OF THE INVENTION

It is an object of the invention to provide a beverage container opener that provides a non-discriminatory alternative to opening a container with exceptional ease and simplicity.

It is another object of the invention to provide a beverage container opener that exploits the basic mechanical characteristics of an inclined plane to lift a lift-tab lever of a container.

The objects of the present invention are achieved by an inventive device that includes a body portion having proximal and distal end areas, whereby the body portion preferably defines a hemispherical internal cavity about a central axis and opening at the distal end area, and a channel that extends along a perimeter of the internal cavity in a preferably spiral inclined planar configuration. The channel generally leads from the opening of the recess and terminates at an apex region of the cavity. The distal end area of the body portion is configured and dimensioned to be placed on a top portion of a beverage container so as to engage a lift-tab lever thereon. Upon rotation of the body portion, the channel engages the lift-tab lever on the beverage container so as to progressively urge an end of the lift-tab lever upwardly to create the aforementioned opening in the top portion of the beverage container.

By design this invention uses the circular shape of the top of a container for concentric alignment, and the top surface profile of the container for positioning the invention at the proper height to reliably engage the lift-tab lever for leverage. The unique characteristics of this invention, combined with the conventionality of the beverage container described herein, provide a simple, non-discriminatory solution to the opening of such containers by persons who have physical challenges, or preferences, that render an intended method of opening these containers impractical or unacceptable.

Numerous other advantages and features of the present invention will become more readily apparent from the following detailed description of the invention, the accompanying examples, drawings and the appended claims.

DETAILED DESCRIPTION OF THE INVENTION

The present invention is a simple device designed to utilize the basic mechanical characteristics of an inclined plane to lift a lift-tab lever on a typical lift-tab-type beverage container and move the same in an intended manner to open the container.

Figure 1:
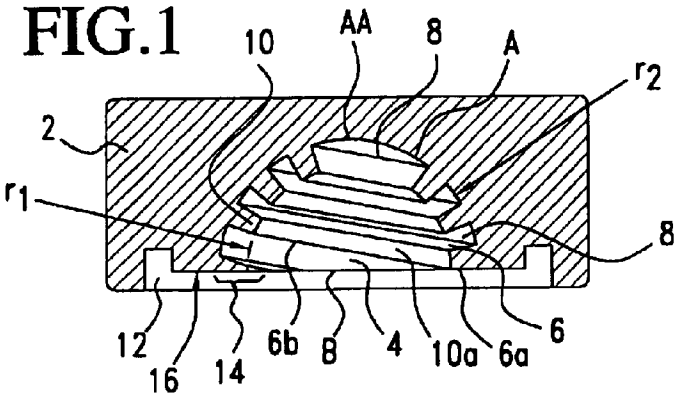
FIG. 1 is a cross-sectional elevational view of a preferred embodiment of the present invention.

As shown in FIG. 1, the illustrated preferred embodiment is presented as a manual version of the present invention. In this embodiment, the invention comprises a puck shaped body portion 2 preferably having a single continuous hemispherical spiral inclined plane channel 4 formed in the body portion 2 and, rising from an opening B thereof to an apex region M of a hemispherical internal cavity A. The channel 4 is defined by a minimum radius $r_1$, and a maximum radius $r_2$. The difference in the radii constitutes the depth of the actuating hemispherical spiral inclined plane surface 6 and the non-actuating hemispherical spiral inclined plane surface 6*b*. The depth of the actuating hemispherical inclined plane surface 6 is configured and dimensioned to sufficiently maintain and permit sliding engagement with a lift-tab lever.

The block material between successive spirals of the channel 4 may be a complementary hemispherical spiral web 10 having a projecting surface 10*a* adjacent to the hemispherical spiral inclined plane surfaces 6 and 6*b*, defined by the minimum radius $r_1$. The effective bottom of the channel 4 at its termination at the apex region AA is preferably an area 8 where the web 10 is removed to the level of the maximum radius $r_2$ and to a width $W_2$ that may be slightly wider than the width of a conventional lift-tab lever. A concentric groove 12 is provided to slidingly accommodate a circular crimped edge located on top of a beverage container to align the body portion 2 and to locate planar surface 16 in close apposition with the top surface of a beverage container.

The entry of the channel 4, and in particular the actuating hemispherical spiral inclined plane surface 6, progresses to a thin section 14 at the planar surface 16 and is configured and dimensioned to enhance the capture of the lift-tab lever of a beverage container. The non-actuating hemispherical spiral inclined plane surface 6*b* eventually merges into the planar surface 16 at which point they converge 6*a*.

The body portion 2 may be constructed from any suitable material, including plastic, metal, glass, ceramic or any suitable combination thereof.

Figure 2:
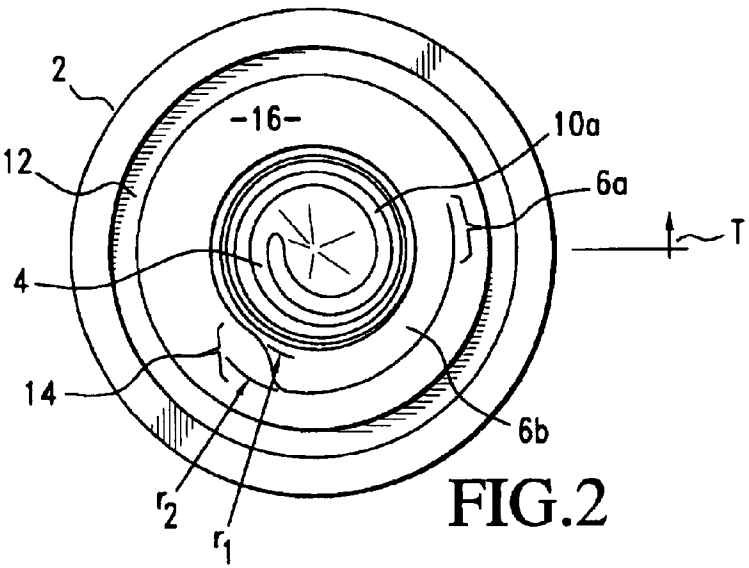
FIG. 2 is a plan view of the embodiment shown in FIG. 1.

FIG. 2 depicts the successive spirals of the hemispherical web 10. The successive spirals are defined by the minimum radius $r_1$ from its origin at the entry 14 of the channel 4 to its termination near the apex region AA of the hemispherical internal cavity A, and the convergence 6*a* of the non-actuating hemispherical spiral inclined plane surface 6*b* of the channel 4 and the planar surface 16. The circular nature of the groove 12 preferably aligns and slidingly engages a circular crimped edge of a top of a beverage container.

Figure 3:
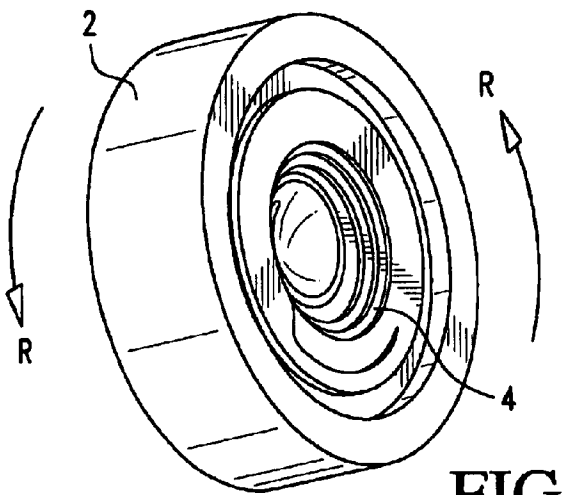
FIG. 3 is a perspective view of a preferred embodiment of the invention showing a direction of rotating the present invention.

As illustrated in FIG. 3, the single continuous hemispherical spiral inclined plane channel 4 may be constructed in a mirror image fashion, and therefore may dictate a direction of rotation R for the operation of the invention.

Figure 4:
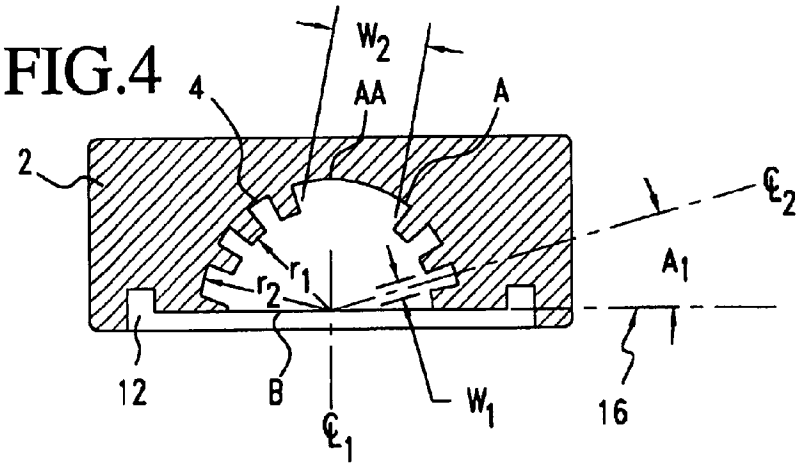
FIG. 4 is a cross-sectional schematic view of the embodiment shown in FIG. 1.

FIG. 4 is a cross section view of the invention showing the angular relationship $A_1$ at centerline $CL_2$ of the single continuous hemispherical spiral inclined planar channel 4, at an arbitrary point along its progression, and the plane surface 16. The range of the angle $A_1$ of the single continuous hemispherical spiral inclined plane channel 4, varies from approximately zero degrees at its convergence, as exemplified in FIGS. 1 and 2, with the planar surface 16, to approximately 90 degrees at its termination at the apex region M. The angle $A_1$ progressively increases from approximately 0 to 90 degrees as a function of the position, in whole turns, T of the body portion 2. The relationship between angle $A_1$ and the number of turns T constitutes the rate of incline of the continuous hemispherical spiral inclined plane channel 4 per unit of turns of the body portion 2, and therefore describes the number of turns of the body portion 2 required to lift a lift-tab lever to operate the invention. This relationship can be expressed as:

$$RI=A_1/T$$

Where:

RI=Rate of incline $A_1$=angle of the continuous hemispherical spiral inclined plane groove T=number of turns of the body portion As the value of RI increases, the number of turns T of the body portion 2 required to effect the complete operation of the invention decreases. Conversely, as the value of RI decreases, the number of turns T of the body portion 2 required to effect the complete operation increases. In the embodiment shown, the value of RI is approximately 25, or 3½ turns. RI can vary according to application or operational preference.

The width $W_1$ of the single continuous hemispherical spiral inclined plane channel 4 is sufficiently larger than the effective thickness of a lift-tab lever to permit the lift-tab lever to slide freely at any location along the single continuous hemispherical spiral inclined plane channel 4.

The centerline $CL_1$ of the body portion 2 at the intersection of the plane surface 16 constitutes the origins of the minimum radius $r_1$, and a maximum radius $r_2$.

Figure 5:
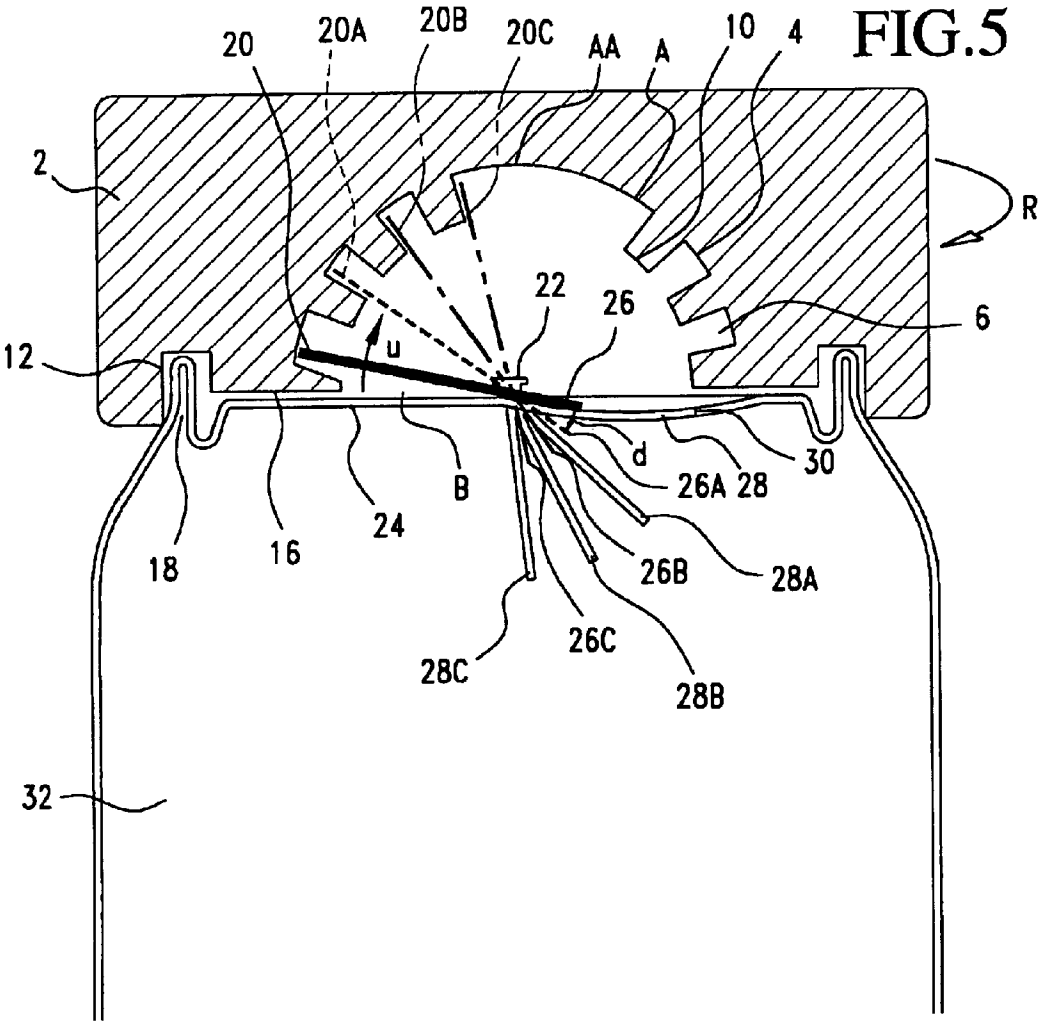
FIG. 5 is a cross-sectional schematic view of the operation of a preferred embodiment of the present invention as applied to a lift-tab lever beverage container.

FIG. 5 illustrates a preferred mode of operation of the present invention and shows the body portion 2 applied to a typical lift-tab container 32 as it begins to affect the opening of the same. The concentric groove 12 of the invention is aligned and slidingly engaged with the circular crimped edge 18 of the top of the beverage container 32. Rotation of the body portion 2, shown by the arrow R, allows the engagement of the actuating hemispherical spiral inclined plane surface 6 of the single continuous hemispherical spiral inclined plane channel 4 with the longer portion of the lift-tab lever 20. As the rotation of the body portion 2 begins, the lift-tab lever 20 engages and slides along the actuating hemispherical spiral inclined plane surface 6 and is forced upward in the direction of the arrow u. This in turn forces the shorter portion of the lift-tab lever 26 downward in the direction of the arrow d by virtue of the rivet 22, a component of the common integrated lift-tab lever mechanism, which acts as a fulcrum.

The shorter portion of the lift-tab lever 26 is in contact with area 28 of the plane surface of the beverage container 24. When sufficient downward force is applied by the shorter portion of the lift-tab lever 26, the area 28 ruptures as intended at point 30, thereby initiating the opening of the container. As the rotation of the invention 2 proceeds, the complete opening of the container 32 is accomplished by the continued upward movement u of the lift-tab lever 20, as shown as 20A, 20B, 20C, which produces a corresponding downward movement d of the shorter portion of the lift-tab lever 26*a*, 26*b*, 26*c* and also areas 28A, 28B, 28C, as shown.

Because of the gently rising angle of the actuating hemispherical spiral inclined plane surface 6, and the inherent friction of both the attachment of the rivet 22 and the contact of the shorter portion of the lift-tab lever 26 with the pre-scribed area 28, the lift-tab lever 20 does not rotate with respect to the container 32 and thereby moves only in a hemispherical arc as intended. Once the lift-tab lever 20 reaches the end of the single continuous hemispherical spiral inclined plane channel 4 at its termination at the apex region AA of the hemispherical internal cavity A, created where the web 10 is removed, acts to limit any further upward movement u, or constraint of the lift-tab lever 20, and any further rotation of the body portion 2 is of no consequence.

It should be pointed out that counter-rotation of the body portion 2 results in urging the lift-tab lever 20 downwardly towards the plane surface 24 of the beverage container due to the non-actuating hemispherical spiral inclined plane surface 6*b*. Furthermore, it should be noted that due to the configuration of the apex region AA of the hemispherical internal cavity A, the invention has an inherent fail-safe design that prevents distortion of the lift-tab 20 if the body portion 2 is persistently rotated beyond its operating range and contains effervescent eruptions.

Figure 6:
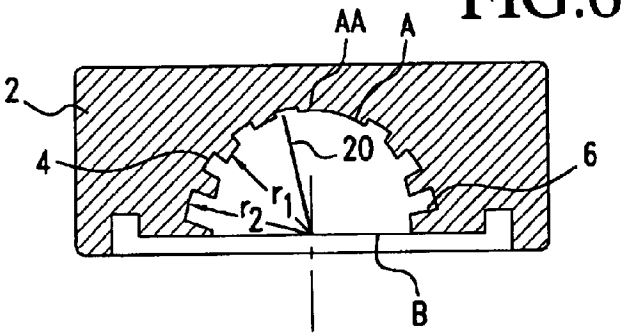
FIG. 6 is a cross-sectional schematic view showing another configuration of the hemispherical spiral channel in a preferred embodiment of the present invention.
Figure 7:
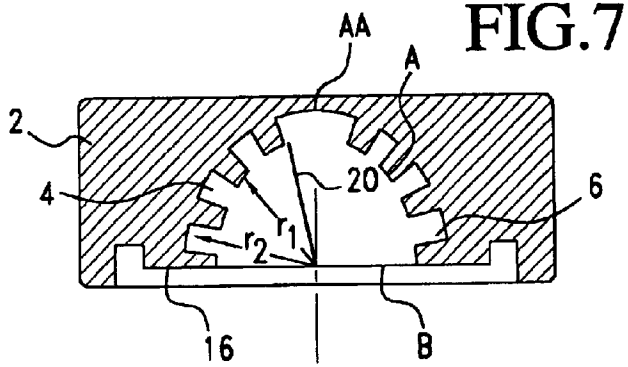
FIG. 7 is a cross-sectional schematic view showing another configuration of the hemispherical spiral channel in a preferred embodiment of the present invention.

As shown in FIGS. 6 and 7, alternate preferred embodiments of the present invention are shown each having a modification to the construction of the single continuous hemispherical spiral inclined plane channel 4. In the embodiment of FIG. 6, the radius $r_1$, progressively increases towards the apex region AA. Alternatively, in the embodiment as shown in FIG. 7, both $r_1$ and $r_2$ are configured and dimensioned so as not to define a hemispherical arc as they rise from the plane surface 16 to the apex region AA, thereby progressively reducing the contact of a lift-tab lever 20 on the actuating hemispherical spiral inclined plane surface 6 until there is no longer any engagement of the channel 4 and the lift-tab lever.

Figure 8:
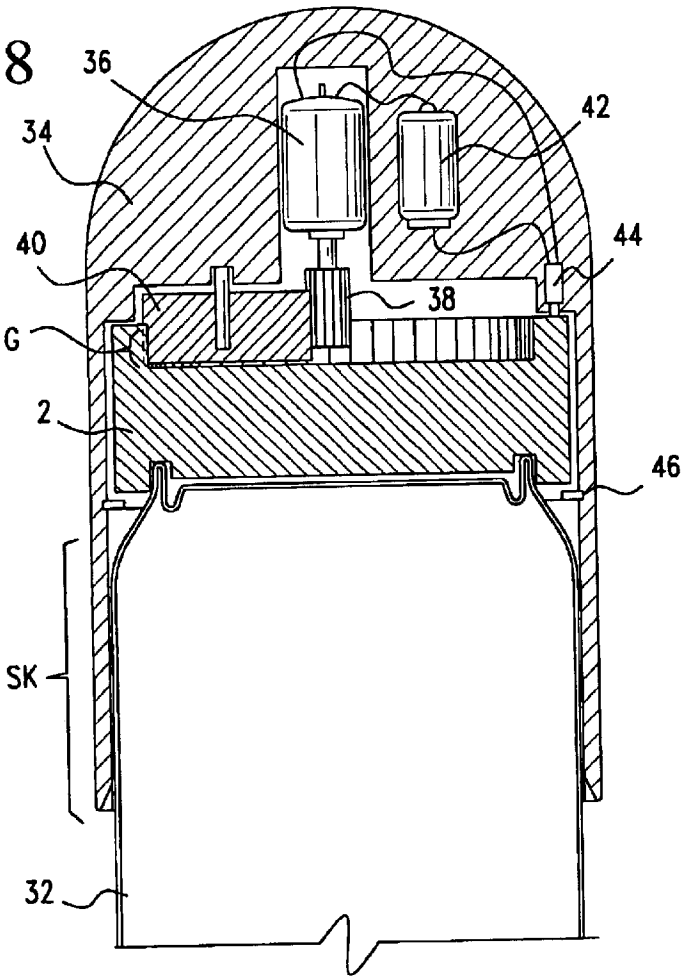
FIG. 8 is a cross-sectional elevational view of a preferred embodiment of the present invention having electro-mechanical features.

FIG. 8 shows a preferred embodiment of the present invention having an electromechanical configuration applied to the container 32. A housing 34 with an alignment skirt SK encloses a motor 36 with a drive gear 38 that engages one or more planetary gears 40, which in turn engage an integrated ring gear G in the body portion 2. The motor is energized by a battery 42 when the switch 44 is closed by upward movement of the body portion 2 when it is applied to the container 32, and affects an opening of the container 32 as described earlier. The retaining clip 46 contains the body portion 2 in the housing 34.

Figure 9:
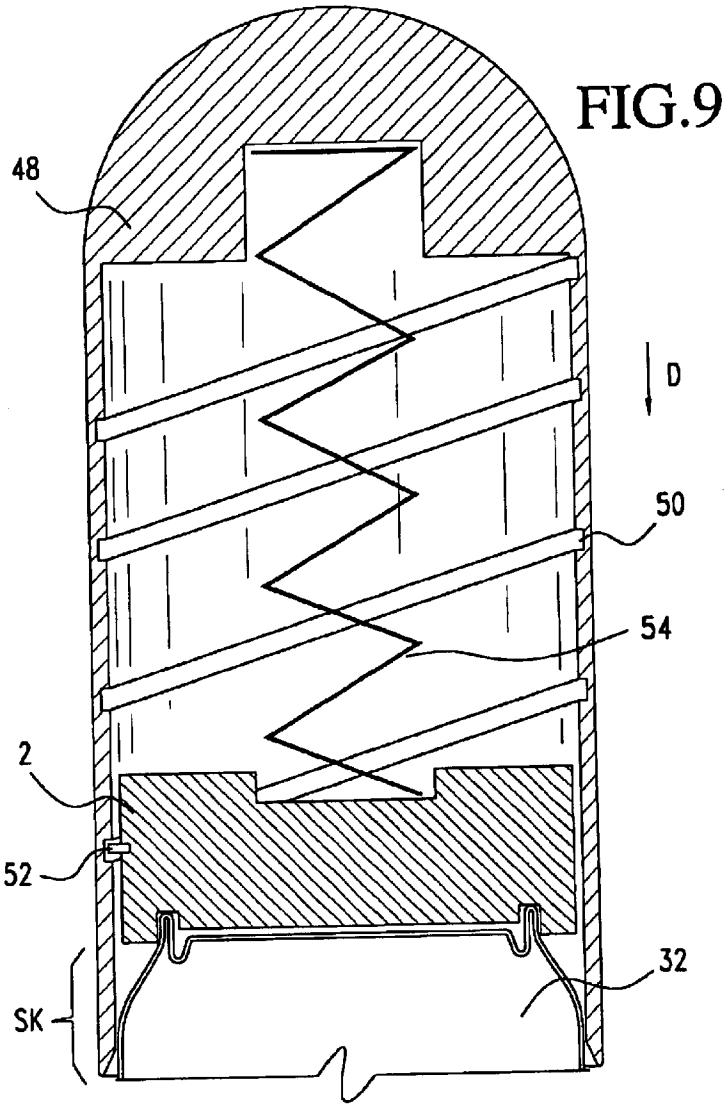
FIG. 9 is a cross-sectional elevational view of a preferred embodiment of the present invention having manual mechanical features.

FIG. 9 shows a manual-mechanical preferred embodiment of the present invention applied to the container 32. A housing 48 preferably includes an alignment skirt SK and a plurality of internal helical grooves 50 that engage a complimentary plurality of pins 52 mounted in the body portion 2. Upon application of a downward force D on the housing 48, the body portion 2 moves in rotating movement in a relatively upwardly direction relative to the housing 48, and is guided by the engagement with the helical grooves 50 thereby causing an opening to form along the top surface of the container 32. A spring 54 returns the body portion 2 to a ready state when the downward force on the housing 48 is removed.

It will be understood that the above described embodiments of the invention are illustrative in nature, and that modifications thereof may occur to those skilled in the art. Accordingly, this invention is not to be regarded as limited to the embodiments disclosed herein, but is to be limited only as defined in the appended claims.

We claim:

1. A device for lifting a lift-tab lever on a container, the device comprising:

a monolithic body portion having proximal and distal end areas, said body portion including a generally hemispherical internal cavity having a central axis and opening at said distal end area, and a channel extending along a perimeter of the hemispherical cavity in a spiral inclined planar configuration leading from the opening of the hemispherical cavity and terminating at an apex region of the hemispherical cavity.

2. The device according to claim 1, wherein the channel is configured and dimensioned to engage a lift-tab lever on a beverage container.

3. The device according to claim 1, wherein the body portion includes a cylindrical recess concentric with the hemispherical cavity and defined as extending into the body portion a predetermined distance from the distal end area thereof.

4. The device according to claim 3, wherein the cylindrical recess defines a recessed planar surface located at said predetermined distance into the body portion, said hemispherical cavity opening at said planar surface of the cylindrical recess.

5. The device according to claim 4, wherein the body portion includes a circular groove concentric with the hemispherical cavity and extending a distance into the body portion from the recess planar surface, said circular groove defined at the outer periphery of the recessed planar surface.

6. The device according to claim 5, wherein the circular groove is configured and dimensioned to engage an outer rim of a beverage container.

7. The device according to claim 1, wherein the channel is located at different radial distances from the central axis of the hemispherical cavity as the channel progresses towards the apex region of the hemispherical cavity.

8. The device according to claim 1, wherein the angle of the channel relative to the central axis of the hemispherical cavity and the distal end area of the body portion increases as the channel progresses towards the apex region of the hemispherical cavity.

9. The device according to claim 1, wherein the channel has a uniform depth relative to the perimeter of the hemispherical cavity.

10. The device according to claim 1, wherein the channel has a gradually decreasing depth as it progresses from the distal end area of the body portion towards the apex region of the hemispherical cavity thereby providing a decrease in surface area of the channel as it progresses towards the apex region of the hemispherical cavity.

11. The device according to claim 1, wherein the body portion is constructed from at least one material selected from the group consisting of metal, plastic, ceramic and glass.

12. The device according to claim 1, wherein the body portion has a generally cylindrical shape.

13. The device according to claim 1, further comprising:

a ring gear connected to a top surface of the body portion;

a motor having a drive gear operatively engaging the ring gear; and a housing including an alignment skirt configured and dimensioned to receive a beverage container, said housing supporting the motor and body portion.

14. The device according to claim 1, further comprising:

a housing including an alignment skirt configured and dimensioned to receive a beverage container, said alignment skirt having an inner periphery including at least one helical groove extending from a proximal portion to a distal portion thereof; and a spring mounted in the top portion of the alignment skirt and operatively engaging the body portion;

wherein the body portion includes at least one pin slidably engaging said at least one helical groove.

15. A device for rotatably lifting a lever, the device comprising:

a body portion having proximal and distal end areas, said body portion including an internal cavity centered about an axis and opening at the distal end area thereof, and at least one channel extending along a perimeter of the internal cavity in an inclined planar configuration leading from the opening of the internal cavity and extending towards a top region of the internal cavity;

wherein the internal cavity has a generally hemispherical cross-sectional profile.

16. The device according to claim 15, wherein the at least one channel has a spiral inclined planar configuration extending from the opening of the internal cavity and terminating at the top region of the internal cavity.

17. The device according to claim 15, wherein the engaging body portion has a generally circular shape.

18. A device for rotatably lifting a lever, the device comprising:

a body portion having proximal and distal end areas, said body portion including an internal cavity centered about an axis and opening at the distal end area thereof, and at least one channel extending along a perimeter of the internal cavity in an inclined planar configuration leading from the opening of the internal cavity and extending towards a top region of the internal cavity;

a ring gear connected to a top surface of the body portion;

a motor having a drive gear operatively the ring gear; and a housing supporting the motor and body portion and including an alignment skirt projecting downwardly from the body portion.

19. The device according to claim 18, further comprising:

a housing including an alignment skirt having an inner periphery with at least one helical groove extending from a proximal portion to a distal portion thereof; and a spring mounted in the proximal portion of the alignment skirt and operatively engaging the body portion;

wherein the cylindrical body portion includes at least one pin slidably engaging said at least one helical groove.

* * * * *